US006328538B1

(12) United States Patent
Rademacher

(10) Patent No.: US 6,328,538 B1
(45) Date of Patent: Dec. 11, 2001

(54) INTEGRATED FUEL PUMP

(76) Inventor: John J. Rademacher, No. 64,2275 W. 25th St., San Pedro, CA (US) 90732

( * ) Notice: Subject to any disclaimer, the term of this patent is extended or adjusted under 35 U.S.C. 154(b) by 0 days.

(21) Appl. No.: 09/374,747

(22) Filed: Aug. 13, 1999

(51) Int. Cl.[7] ..... F04B 49/00; F04B 17/00
(52) U.S. Cl. ..... 417/307; 417/360; 417/310
(58) Field of Search ..... 417/360, 307, 417/310, 410.3

(56) References Cited

U.S. PATENT DOCUMENTS

| | | | | |
|---|---|---|---|---|
| 2,983,226 | * | 5/1961 | Livermore | 103/42 |
| 3,402,733 | * | 9/1968 | McAlvay | 137/467.5 |
| 4,580,951 | * | 4/1986 | Carleton et al. | 417/366 |
| 4,822,258 | * | 4/1989 | Matsuda et al. | 417/423.3 |
| 5,007,806 | * | 4/1991 | Bellis et al. | 417/360 |
| 5,181,835 | * | 1/1993 | Cook | 417/310 |

* cited by examiner

*Primary Examiner*—Timothy S. Thorpe
*Assistant Examiner*—Timothy P. Solak
(74) *Attorney, Agent, or Firm*—Curtis L. Harrington

(57) ABSTRACT

The integrated electric fuel pump provides at least three sets of four internally threaded bores, one set on one side of the fluid pump housing, a second set oppositely located with respect to the first set, and a third set disposed toward the end of the fluid pump housing. This enables the integrated electric fuel pump to be secured with four threaded members, complete with rubber isolators, and oriented in three ways, two involving a 180° rotation of the fuel pump which will enable the inlet and outlet to change sides. At one end of the fluid pump housing, an electric motor is integrated with the brushes of the motor supported by the integrated pump housing to enable larger brushes and longer urged brush support structures. The metal wall of the housing draws heat from the brushes of the electric motor, and provides spreading and larger surface radiation of the heat along the pump body as well as some heat transfer into the fuel passing within the pump body. A bypass system is included which incorporates a selectable bypass/return configuration in an elongate housing mounted along the bottom of the pump housing. The bypass uses a metal ball and spring pre-set for a maximum limit of outlet pressure beyond which recirculation will occur.

15 Claims, 2 Drawing Sheets

INTEGRATED FUEL PUMP

FIELD OF THE INVENTION

The present invention relates to the field of high performance automotive equipment and more specifically to a multi-position mountable fuel pump having a dual mode bypass/return with a structure which integrates the pumping motor brushes and commutator closer and partially into the fuel pumping unit to provide cooling for the integrated pumping unit.

BACKGROUND OF THE INVENTION

Conventional electric fuel pumps have an electric motor mounted next to the pumping unit and share a common drive shaft. The motor brushes are located at the far end of the unit, opposite the pumping unit. Where an electric fuel pump size reduction is to be had, to reduce its overall size, the electric motor brush structure suffers an intensified size reduction affecting its efficiency and longevity. Since the shaft and rotor have to be of sufficient size to develop the torque to drive the electric motor, their size approaches a lower limit. Generally the exterior most portion of the brushes suffer the same separation restriction in order to stay no more than flush with the external portion of the electric motor body. Brushes which must operate within a restricted lower limit size have very little operating room and are forced to be quite small in terms of both length and cross-sectional area. The size of the brushes are related to the arc width of the contacts on the armature. A larger diameter of armature contact assembly would provide for brushes of larger cross sectional area, but the length of the brush bore which supports the contact force spring, brush and electrical contact has a minimum length requirement, and must reside in the radial space which includes spacing for the commutator, brushes and their wear length, springs and their length of urging force contact ability over the wear length, and the electrical contacts used to connect conductors to the brushes.

Another limitation and condition is thermal waste heat. The arcing and eddy currents which occur at the commutator is significant. Where the commutator area is open, as with most motors, sufficient ventilation occurs. However, in a hydrocarbon environment exposure and ventilation could easily spark a fire or explosion. Consequently, electrical "explosion proof" standards and structure are employed at the brush end of a motor in order to try to provide ventilation for cooling and at the same time limit availability of the open spark to flammable hydrocarbons. This usually requires a heavy set of baffles which enable ventilation but which will suppress ignition.

Another problem involves the stability of the connection between the motor and pump. For cheaper pumps, the strength of the shaft is significantly relied upon to give rigidity of the pump and motor combination. It would be desirable for the pump and motor combination to be more highly integrated so that less reliance would be had on the shaft strength in forming an integrated unit.

What is therefore needed is a truly integrated pump and motor combination which will allow larger cross section brushes, more room for the brushes to move and wear, which all but eliminates the sparking ability of the commutator to cause fires, but without all of the extra structure and requirements to permit ventilation simultaneous with cooling, and which enables ease of mounting in different positions.

SUMMARY OF THE INVENTION

The integrated electric fuel pump provides at least three external sets of four internally threaded bores, one set on one side of the fluid pump housing, a second set oppositely located with respect to the first set, and a third set disposed toward the end of the fluid pump housing. This enables the integrated electric fuel pump to be secured with four threaded members, complete with rubber isolators, and oriented in three ways, two involving a 180° rotation of the fuel pump which will enable the inlet and outlet to change sides. At one end of the fluid pump housing, an electric motor is integrated with the brushes of the motor supported by the integrated pump housing to enable larger brushes and longer urged brush support structures. The metal wall of the housing draws heat from the brushes of the electric motor, and provides spreading and larger surface radiation of the heat along the pump body as well as some heat transfer into the fuel passing within the pump body. A bypass system is included which incorporates a bypass/return configuration in an elongate housing mounted along the bottom of the pump housing. The bypass uses a metal ball and spring pre-set for a maximum limit of outlet pressure beyond which recirculation will occur and is designed for recirculating over pressure relief. Recirculation is disabled by insertion of a plug at the suction end of the integrated pumping unit, and which would block the path of fuel to the suction end of the pump. A remote bypass is had by replacing a blind plug with a fitting to an independent outlet for attachment of an independent flow line leading back to the tank. In typical usage the internal bypass will have a lower pressure limit than the external bypass back to the tank.

BRIEF DESCRIPTION OF THE DRAWINGS

The invention, its configuration, and its construction will be further depicted in the following detailed description, taken in conjunction with the accompanying drawings in which.

DETAILED DESCRIPTION OF THE PREFERRED EMBODIMENT

Figure 1:
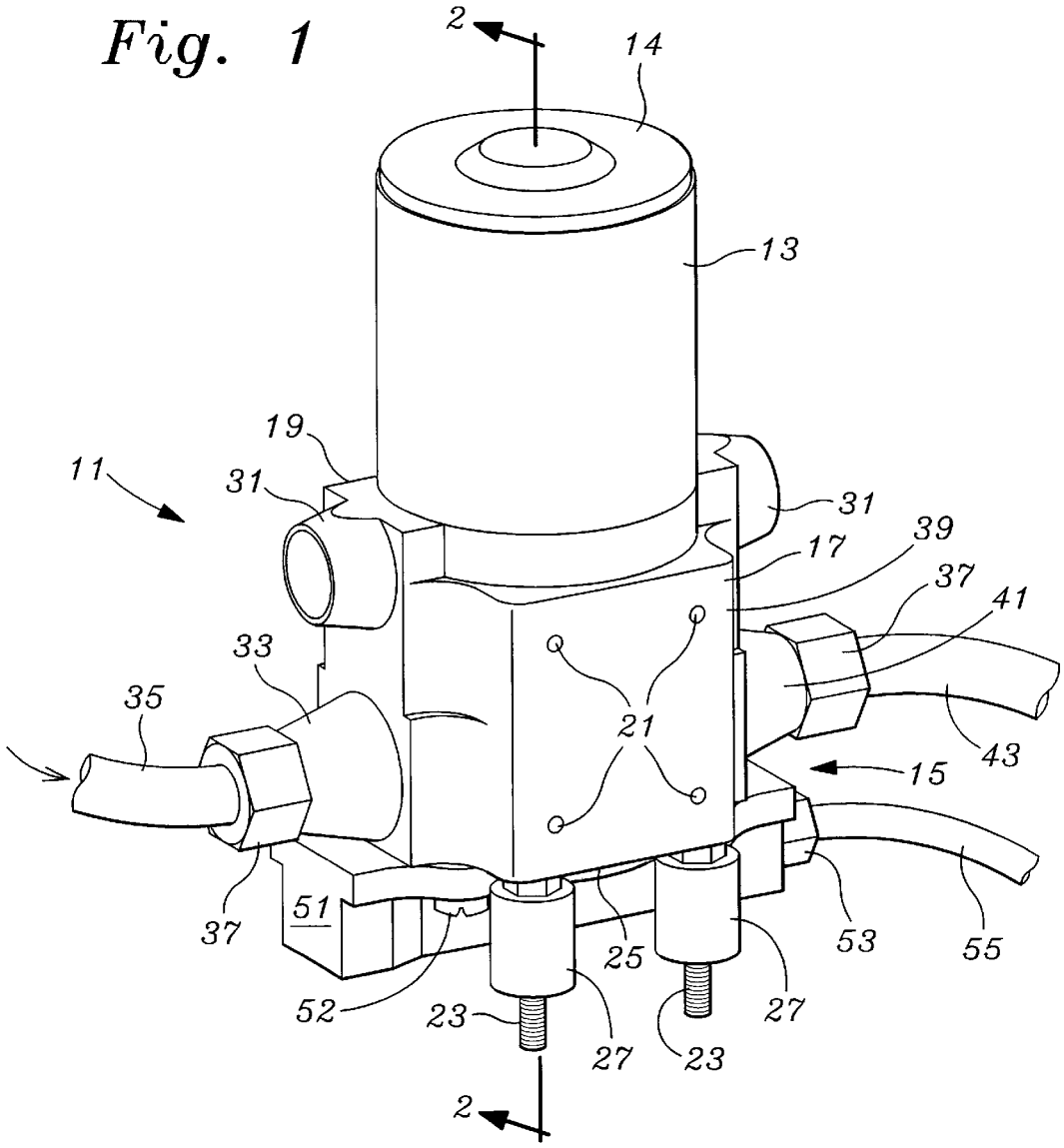
FIG. 1 is an illustration of a perspective view of the integrated pump of the invention shown in an end mounted configuration with threaded members and rubber isolators.

The invention will be best described with reference to FIG. 1 which illustrates a perspective view of an integrated electric motor and fuel pump, hereinafter integrated fuel pump 11. The integrated fuel pump 11 includes a plainly cylindrically shaped upper motor housing 13 which is connected atop an integrated pump housing 15, and which may, as well be seen provide some rotational support and stabilization to a motor shaft, especially with upper cap 14 which may include a space for securing a motor shaft bearing. Integrated pump housing 15 includes oppositely disposed sides 17 and 19, each of which are provided with threaded mounting bores 21 for accommodating four mounting bolts 23 seen protruding from an end 25 of the integrated pump housing 15. Mounting bolts 23 have rubber isolators 27 to keep tension on the mounting bolts 23 and to absorb vibrational energy between the integrated fuel pump 11 and the structure onto which it is mounted, and can be used no matter whether the bolts 23 are supporting the integrated fuel pump 11 from the end 25, or the oppositely disposed sides 17 and 19.

At the upper portion of the integrated pump housing 15, a pair of enlarged brush access apertures 31 are seen as having a tapering conical exterior. A brush assembly including a solid brush with urged engagement spring and rear conductor connector are mountable directly in the apertures 31, and can be accessed and changed without any further disassembly of the integrated fuel pump 11.

On a side most prominent with respect to the observer, and below the aperture 31 is a pump inlet 33 which may be attached to a fuel line 35 with a connection fitting 37. At the opposite side with respect to the inlet 33 is an outlet 39 to which may be attached an outlet fitting 41 and an outlet hose 43.

Below the end 25 is an external bypass/return structure 51. Bypass/return structure 51 can be configured to enable an internal return within the fuel pump 11, or configured to include an external return to anywhere in the fuel system, and typically to the supply tank from which the fuel was originally drawn. From the external bypass/return structure 51, a fitting 53 attaches a hose 55 extending away from the integrated fuel pump 11, is typically used in a higher pressure bypass limit arrangement and 55 typically leads back to the fuel tank (not shown). This configuration for high-pressure bypass insures that any heat generated from flow friction will be dissipated over a relatively long distance, and continue to provide a fresh, cool supply of fuel from the fuel tank and return back to the fuel tank. Overheating should not occur so long as the fuel flows freely.

Figure 2:
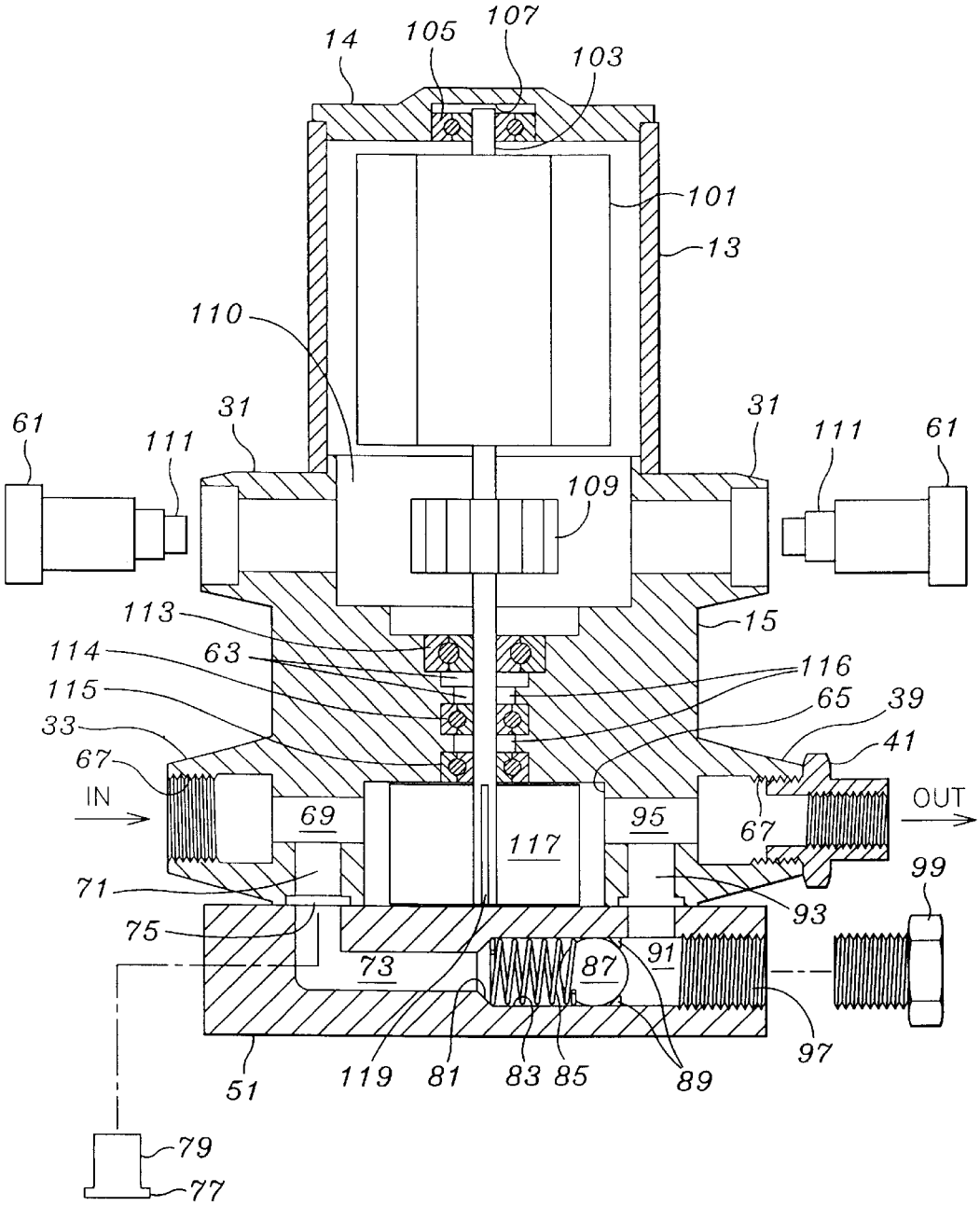
FIG. 2 is a sectional view of the integrated pump with external bypass taken along line 2—2 of FIG. 1 and with the brush supports shown in exploded view.

Referring to FIG. 2, a sectional view taken along line 2—2 of FIG. 1 illustrates the internals of the integrated fuel pump 11. Seen are brush connector assemblies 61 displaced slightly from the brush access apertures 31. Brush connector assemblies 61 will typically house the contacting and urging components for electrical contact with a commutator of a rotor, and may include externally directed sockets for quick connect of power leads (not shown). The integrated pump housing 15 includes a shaft access bore 63 and an impeller space 65. The inlet 33 and outlet 39 each contain a threaded surface 67 at their outer ends to enable the fittings 41 and 37 to be threadably inserted. Toward the middle of the integrated fuel pump 11, from the threads 67 of the pump inlet 33, an inlet side flow bore 69 includes an inlet side return bore 71 in communication with a flow bore 73 within the external bypass/return structure 51. A chamfer 75 at the inlet side return bore 71 adjacent the end 25 of the integrated pump housing 15 facilitates the solidly urged interfitting of a head 77 of a plug 79, typically made of elastomeric material, which can be used to shut off the access of the flow bore 73 back to the inlet side return bore 71 when the internal return flow is to be blocked and the external flow is to be facilitated. The portions of the plug 79 at the outer periphery of the chamfer will be securely held into the chamfer once the external bypass/return structure 51 is re-implaced onto the integrated pump housing 15.

Adjacent the flow bore 73, a chamfered opening 81 leads to an enlarged bore 83 containing a spring 85 urging a spherical flow element 87. In a position urged to the right, the spherical flow element 87 rests against a valve seat 89. To the right of the valve seat 89 an abbreviated length flow bore 91 communicates with an outlet side return bore 93. Outlet side return bore 93 is in communication with an outlet side flow bore 95. When the pressure of the outlet side flow bore 95 exceeds the rating of the spring 85, the spherical flow element 87 will be urged to the left to enable fuel to begin to bypass back through the inlet side return bore 71 to recirculate through the integrated pump housing 15.

Also seen to the right of the spherical flow element 87 is a threaded bore 97 so that the open end of the external bypass/return structure 51 can be open, but closable. The threaded bore 97 can connect to either the fitting 53 and hose 55 for return to the fuel tank, or to a plug 99 which is about the same size as the fitting 53 but provides a blind shut off. FIG. 2 illustrates both plug 99 and 79, although in actual use, only one will be utilized.

Where the over pressure path is to flow from the outlet side flow bore 95 through the outlet side return bore 93, flow bore 73, inlet side return bore 71, to the inlet side flow bore 69 to form a circular flow path, the plug 79 will be absent, and the plug 99 will be in place. The fluid pressure within the outlet side return bore 93 and flow bore 91 will be sufficient to displace the spherical flow element away from the valve seat 89 to enable flow around the spherical flow element 87, through the spring 85 and through the flow bore 73 to recirculate through the impeller space 65. In this configuration, fuel will continuously re-circulate through the integrated pump housing 15.

Where the over pressure path is to flow back to the fuel tank, the line 55 will be provided with the fitting 53 and leading directly back to a fuel tank (not shown). The plug 79 will be placed within the inlet side return bore 71 to block off the return path through the external bypass/return structure 51. The plug 99 is replaced by the fitting 53, and the flow path back to the fuel tank will be complete. In order to keep pressure up in the exit line, the spherical valve element 87 may partially block or constrict the outlet flow path through the flow bore 91, in order to insure that the outlet pressure in the outlet side flow bore 95 remains sufficiently high for delivery the engine downstream of the fitting 41. Alternatively, the flow line 55 or fitting 53 may contain an appropriate restriction or even an external spherical-type flow restrictor to provide either a pressure drop or pressure threshold for resistance to fuel leading back through flow line 55.

The driving force for the fuel is provided by a rotor 101 having a shaft 103 which is supported by a bearing 105 which rests in a shallow blind bore 107 at the top of the cylindrically shaped upper motor housing 13. Also supported by the shaft 103 is a commutator 109 positioned withing a motor space 110 in the upper portion of the integrated pump housing 15, to contact the brushes 111 which are spring mounted within the brush connector assemblies 61. Other bearing and seal structures 113, 114, and 115 also support, isolate and rotatably facilitate turning of the shaft 103, as well as to make certain that the fuel within the impeller space 65 is completely isolated from the motor space 110 of the integrated pump housing 15. Bearing and seal structures 113, 114, and 115 also define a pair of oil galley spaces 116 between the bearing and seal structures 113, 114, and 115 for holding a much heavier grease or other lubrication fluid to help further isolate impeller space 65 is completely isolated from the motor space 110. A set of vanes 117 on an impeller 119 provide the pumping action within the impeller space 65.

The present invention may be used in any setting in which integration between a pump and motor is had, in which larger area of wear brushes are desired to be employed, in which varied mounting configurations bring expanded utility, and wherever variable over pressure configurations are to be employed. Multiple variations on this invention are certainly possible, since variations can occur with any one or any combination of the components of several of the integrated structures, over pressure mechanisms and structures, and mounting structures. Modifications to all parts of the invention may occur to those skilled in the art, and those modifications may be produced without departing from the spirit and scope of the invention. Therefore, included within the patent warranted hereon are all such changes and modifications as may reasonably and properly be included within the scope of this contribution to the art.

What is claimed:

1. An integrated electrically driven fuel pump comprising:

an electric motor rotor having a shaft supporting a commutator;

an integrated pump housing having an upper motor space for at least partially surrounding said electric motor commutator and at least one brush access aperture in communication with said upper motor space, and an impeller space in communication with a pump inlet and a pump outlet, and an opening between said upper motor space and said impeller space for closely accommodating said shaft; and an inlet side return bore having a first end in communication with said pump inlet and a second end opening to an exterior surface of said integrated pump housing, and an outlet side return bore having a first end in communication with said pump outlet and a second end opening to said exterior surface of said integrated pump housing, and further comprising a bypass/return structure having a flow bore having a first open end alignable with said second end of said outlet side return bore and a second open fitting end, and an abbreviated length flow bore having a first end in communication with said flow bore and a second open. end alignable with said second end of said outlet side return bore, said bypass/return structure sealably attachable to said exterior surface of said integrated pump housing; and wherein said second end of said inlet side return bore has a chamfer adjacent said second end opening to said exterior surface of said integrated pump housing to accommodate a head of a plug fittable at least partially into said inlet side return bore for disabling return of fluid back to said pump inlet; and an impeller carried by said shaft within said impeller space.

2. The integrated electrically driven fuel pump recited in claim 1 and wherein said integrated pump has a pair of oppositely disposed sides and an end, each of which carries threaded bores for mounting said integrated pump housing to another structure.

3. The integrated electrically driven fuel pump recited in claim 1 and further comprising a flow restriction structure within said flow bore of said bypass/return structure has a flow restriction between said first open end and said second open fitting end.

4. The integrated electrically driven fuel pump recited in claim 3 wherein said flow restriction structure within said flow bore further comprises a valve element, a spring urging said valve element to a position to restrict flow through said flow bore, said valve element moveable against said spring to permit flow of fluid through said flow bore.

5. The integrated electrically driven fuel pump recited in claim 1 wherein said second open fitting end of said flow bore includes threads for engagement of one of a plug, for return of fluid back to said pump inlet, and a fitting, for return of fluid to a reservoir.

6. The integrated electrically driven fuel pump recited in claim 1 and further an upper motor housing which, with said integrated pump housing, surrounds and encloses said rotor.

7. The integrated electrically driven fuel pump recited in claim 1 and further comprising sealing structures adjacent said opening between said upper motor space for insuring that a fluid within said impeller space is isolated from said upper motor space.

8. The integrated electrically driven fuel pump recited in claim 7 wherein said sealing structures are a plurality of sealing structures and including at least one oil galley space between said plurality of sealing structures for accommodating a heavy grease for further insuring that a fluid within said impeller space is isolated from said upper motor space.

9. The integrated electrically driven fuel pump recited in claim 1 and wherein said commutator is located between said impeller and said rotor.

10. An integrated electrically driven fuel pump comprising:

an upper motor housing;

an integrated pump housing connected to said upper motor housing, said integrated pump housing having an upper motor space continuous with an internal motor space of said upper motor housing, an impeller space in communication with a pump inlet and a pump outlet, and an opening between said upper motor space and said impeller space for closely accommodating a shaft extending therebetween, and wherein said integrated pump housing includes an inlet side return bore having a first end in communication with said pump inlet and a second end opening to an exterior surface of said integrated pump housing, and an outlet side return bore having a first end in communication with said pump outlet and a second end opening to said exterior surface of said integrated pump housing, and further comprising a bypass/return structure having a flow bore having a first open end alignable with said second end of said outlet side return bore and a second open fitting end, and an abbreviated length flow bore having a first end in communication with said flow bore and a second open end alignable with said second end of said outlet side return bore, said bypass/return structure sealably attachable to said exterior surface of said integrated pump housing, and wherein said second end of said inlet side return bore has a chamfer adjacent said second end opening to said exterior surface of said integrated pump housing to accommodate a head of a plug fittable at least partially into said inlet side return bore for disabling return of fluid back to said pump inlet;

an electric motor rotor having said shaft and windings about said shaft, said shaft also supporting a commutator; and an impeller carried by said shaft within said impeller space.

11. The integrated electrically driven fuel pump recited in claim 10 and wherein said integrated pump has a pair of oppositely disposed sides and an end, each of which carries threaded bores for mounting said integrated pump housing to another structure.

12. The integrated electrically driven fuel pump recited in claim 10 and further comprising a flow restriction structure within said flow bore of said bypass/return structure has a flow restriction between said first open end and said second open fitting end.

13. The integrated electrically driven fuel pump recited in claim 10 wherein said flow restriction structure within said flow bore further comprises a valve element, a spring urging said valve element to a position to restrict flow through said flow bore, said valve element moveable against said spring to premit flow of fluid through said flow bore.

14. The integrated electrically driven fuel pump recited in claim 10 wherein said second open fitting end of said flow bore includes threads for engagement of one of a plug, for return of fluid back to said pump inlet, and a fitting, for return of fluid to a reservoir.

15. The integrated electrically driven fuel pump recited in claim 10 and wherein said commutator is located between said impeller and said rotor.

* * * * *